US006761669B1

(12) United States Patent
Pan et al.

(10) Patent No.: US 6,761,669 B1
(45) Date of Patent: Jul. 13, 2004

(54) TREADMILL WITH A STATIC ELECTRICITY FREE HANDLE ASSEMBLY

(75) Inventors: John C. Pan, Taichung (TW); Hung-Lung Uen, Taichung (TW); Shih-Huang Chu, Taichung (TW)

(73) Assignee: Forhouse Corporation (TW)

( * ) Notice: Subject to any disclaimer, the term of this patent is extended or adjusted under 35 U.S.C. 154(b) by 0 days.

(21) Appl. No.: 10/352,056

(22) Filed: Jan. 28, 2003

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 3,713,438 A * 1/1973 Knutsen ..... 601/35
4,227,487 A * 10/1980 Davis ..... 119/700

OTHER PUBLICATIONS

Patent application Publication US 2003/0186787, Wu et al. Static Electricity Remover of a Treadmill, Oct. 2, 2003.*

* cited by examiner

*Primary Examiner*—Nicholas D. Lucchesi
*Assistant Examiner*—Tam Nguyen
(74) *Attorney, Agent, or Firm*—Bacon & Thomas, PLLC

(57) ABSTRACT

A treadmill has a stand, a running assembly, a handle assembly and an insulation connecting assembly. The insulation connecting assembly is mounted on the stand to keep the handle assembly from electrically connecting with the running assembly. In such an arrangement, a static electricity free handle assembly is mounted on the treadmill to keep the static electricity from being discharged when the user contacts with the handle assembly.

12 Claims, 7 Drawing Sheets

TREADMILL WITH A STATIC ELECTRICITY FREE HANDLE ASSEMBLY

BACKGROUND OF THE INVENTION

1. Field of the Invention

The present invention relates to a treadmill, and more particularly to a treadmill with a handle assembly that is free from static electricity.

2. Description of Related Art

A conventional treadmill comprises a running belt for a user running on the treadmill so as to provide an exercising effect to the user. When the user uses the treadmill for exercise, static electricity is always generated due to the friction between the shoes that the user wears and the running belt. When the user contacts with the handle that is attached to a metal stand, the static electricity will be discharged from the user's body to the ground through the handle and the stand whereby the user receives a shock and may be injured.

To avoid injury by static electricity, a coat made of an insulation material, such as foam rubber or plastic, is always mounted on the handle. The coat can keep the user from directly contacting with the metal handle, such that the static electricity discharge is prevented. However, the coat is easily damaged due to the perspiration on the hands and gripping by the user after a period time of use. This damaged coat will also give a bad appearance to the treadmill.

To overcome the shortcomings, the present invention tends to provide a treadmill with a static electricity free handle assembly to mitigate or obviate the aforementioned problems.

SUMMARY OF THE INVENTION

The main objective of the invention is to provide a treadmill with a static electricity free handle assembly that can keep the static electricity from being discharged when the user contacts with the handle assembly. The treadmill has a stand, a running assembly, a handle assembly and an insulation connecting assembly. The insulation connecting assembly is mounted on the stand to keep the handle assembly from electrically connecting with the running assembly. Consequently, a static electricity free handle assembly is mounted on the treadmill to keep the user from being injured by static electricity.

Other objects, advantages and novel features of the invention will become more apparent from the following detailed description when taken in conjunction with the accompanying drawings.

DETAILED DESCRIPTION OF PREFERRED EMBODIMENT

Figure 1:
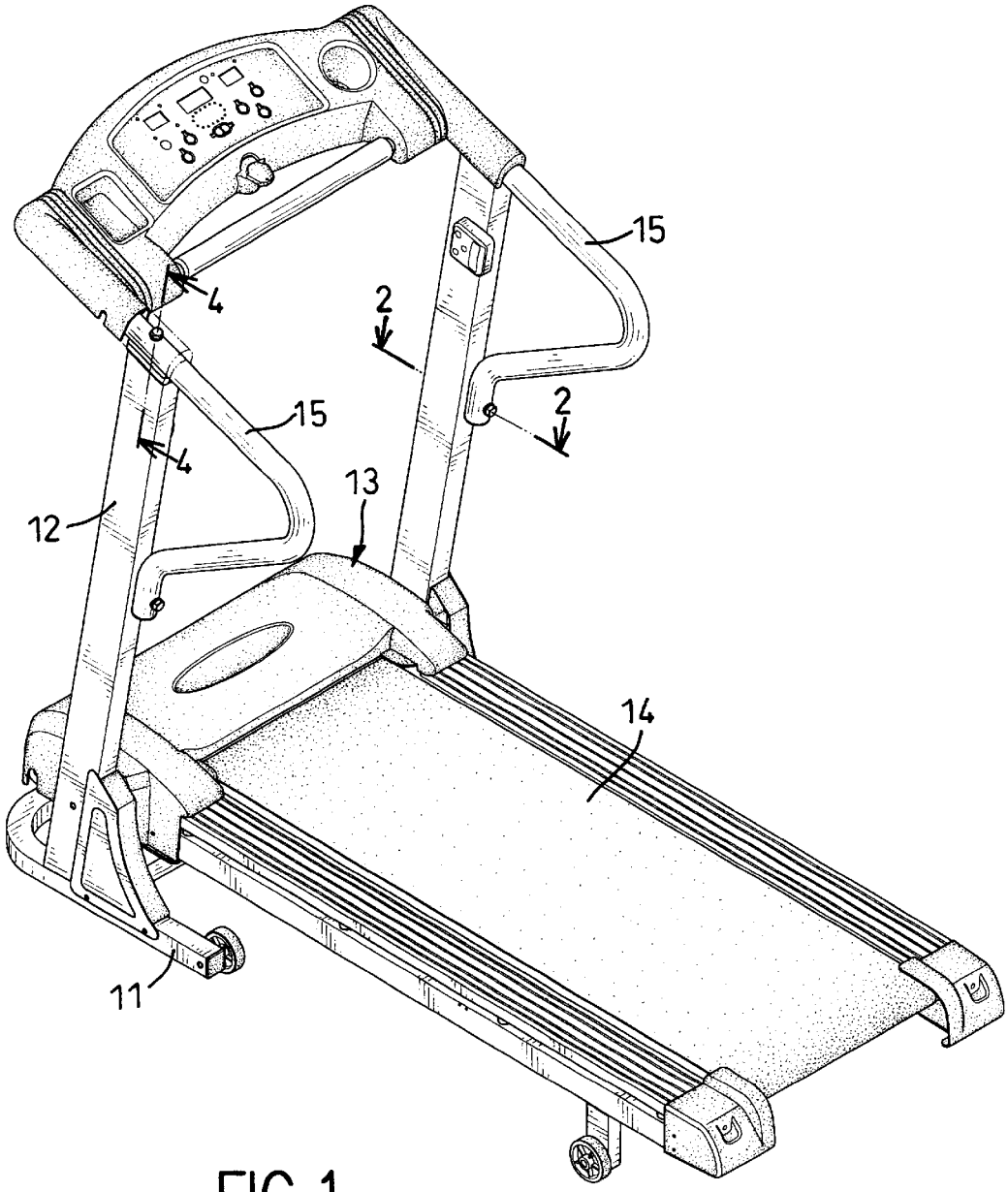
FIG. 1 is a perspective view of a first embodiment of a treadmill in accordance with the present invention.

With reference to FIG. 1, a treadmill in accordance with the present invention comprises a stand, a running assembly, a handle assembly and an insulation connecting assembly. The stand comprises a base (11) and two posts (12) extending upward from the base (11). The running assembly is mounted between the two posts (12) and comprises a frame (not numbered), a running belt (14) and a driving assembly (13). The frame is mounted between the posts (12). The running belt (14) is mounted around the frame. The driving assembly (13) is attached to the frame to drive the running belt (14) to move around the frame in a loop. The driving assembly (13) always has a grounding line electrically connected to the ground.

The handle assembly is attached to the stand. In practice, the handle assembly comprises two handles (15) respectively secured to the posts (12).

The insulation connecting assembly is mounted on the stand to keep the handle assembly from electrically connecting with the running assembly and the ground. In a first embodiment, the insulation connecting assembly comprises an insulation connecting device mounted on each respective position where each respective handle (15) is attached to the corresponding one of the posts (12).

Figure 2:
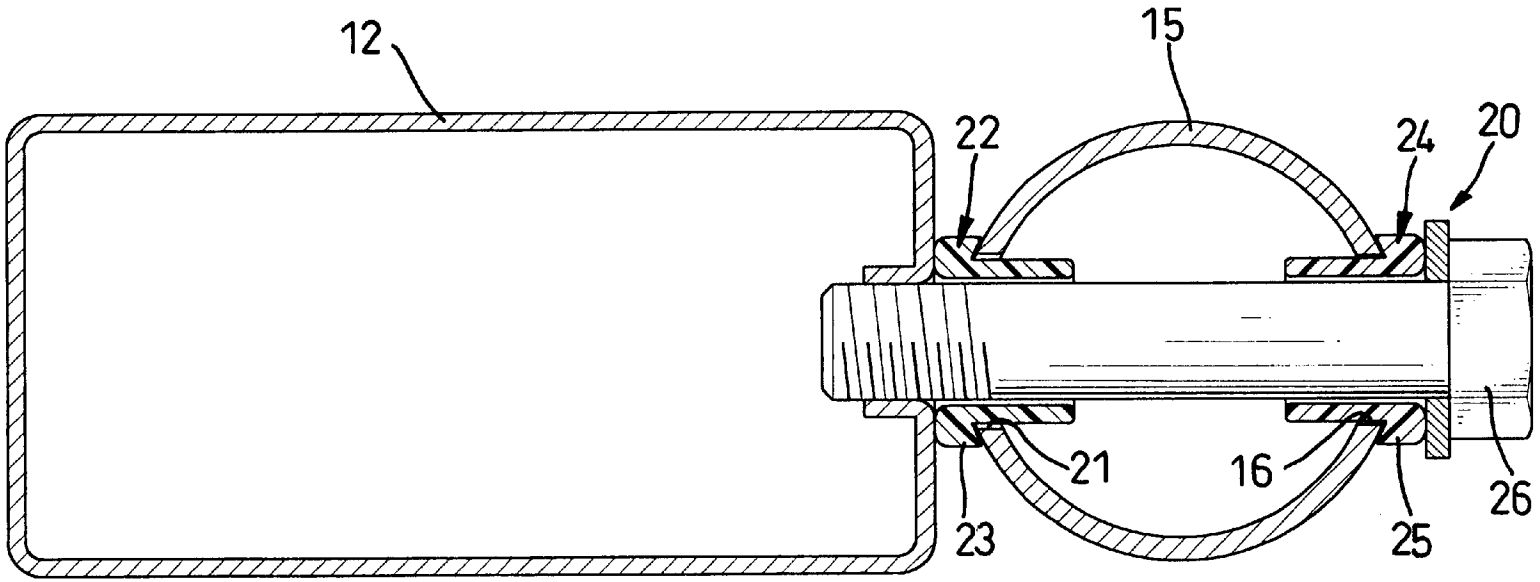
FIG. 2 is a side plan view in partial cross section of a first insulation connecting device of the treadmill along line 2—2 in FIG. 1.

With reference to FIGS. 1 and 2, a first insulation connecting device (20) is mounted between the bottom end of each respective handle (15) and the corresponding post (12). Each first insulation connecting device (20) comprises a through hole (16), a thread hole (not numbered), two insulation elements (22,24) and a bolt (26). The through hole (16) is defined through the corresponding one of the handles (15). The thread hole is defined in the corresponding post (12) and aligns with the through hole (16) in the corresponding handle (15). The insulation elements (22,24) are made of an insulation material, and each has a passage defined through the insulation element (22,24). The insulation elements (22,24) are respectively mounted in two ends of the through hole (16) to keep the handle (15) from contacting with the corresponding post (12). In practice, each insulation element (22,24) has a sleeve (not numbered) inserted into one end of the through hole (16) in the corresponding handle (15) and a head (23,25) connected to the sleeve and exposed from the handle (15). The head (23) of one of the insulation elements (22) is located between the corresponding handle (15) and the corresponding post (12) to separate the handle (15) from the corresponding post (12). At least one protrusion (not shown) is formed on the sleeve of each insulation element (22,24) and abuts the inner surface of the corresponding handle (15). This can keep the insulation elements (22,24) from escaping from the through hole (16) in the handle (15).

The bolt (26) penetrates through the passages of the insulation elements (22,24) and is screwed into the thread hole in the corresponding post (12), such that the bottom of the handle (15) is securely attached to the corresponding post (12) through the first insulation connecting device (20).

Figure 3:
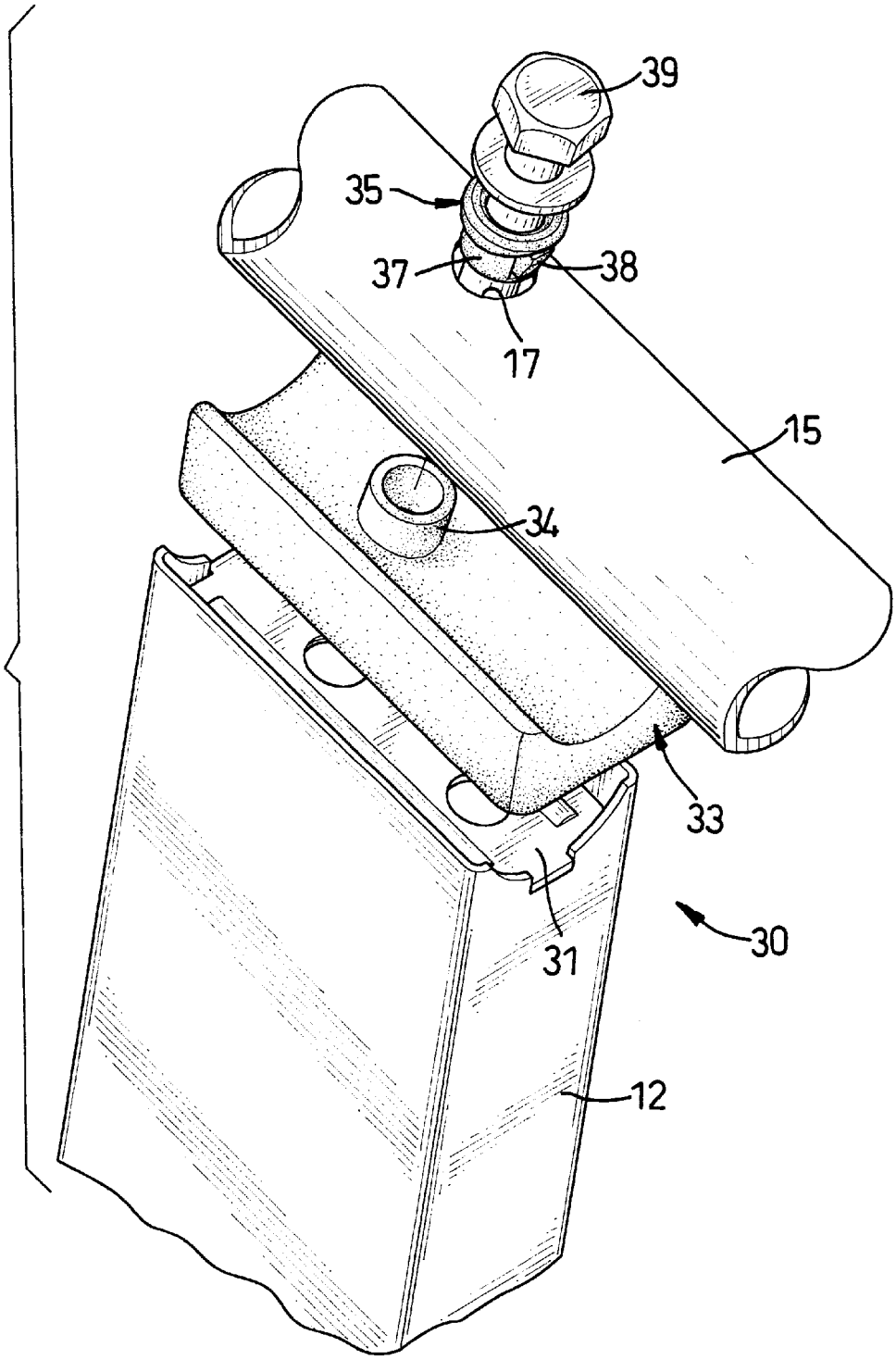
FIG. 3 is an exploded perspective view of a second insulation connecting device of the treadmill in FIG. 1.
Figure 4:
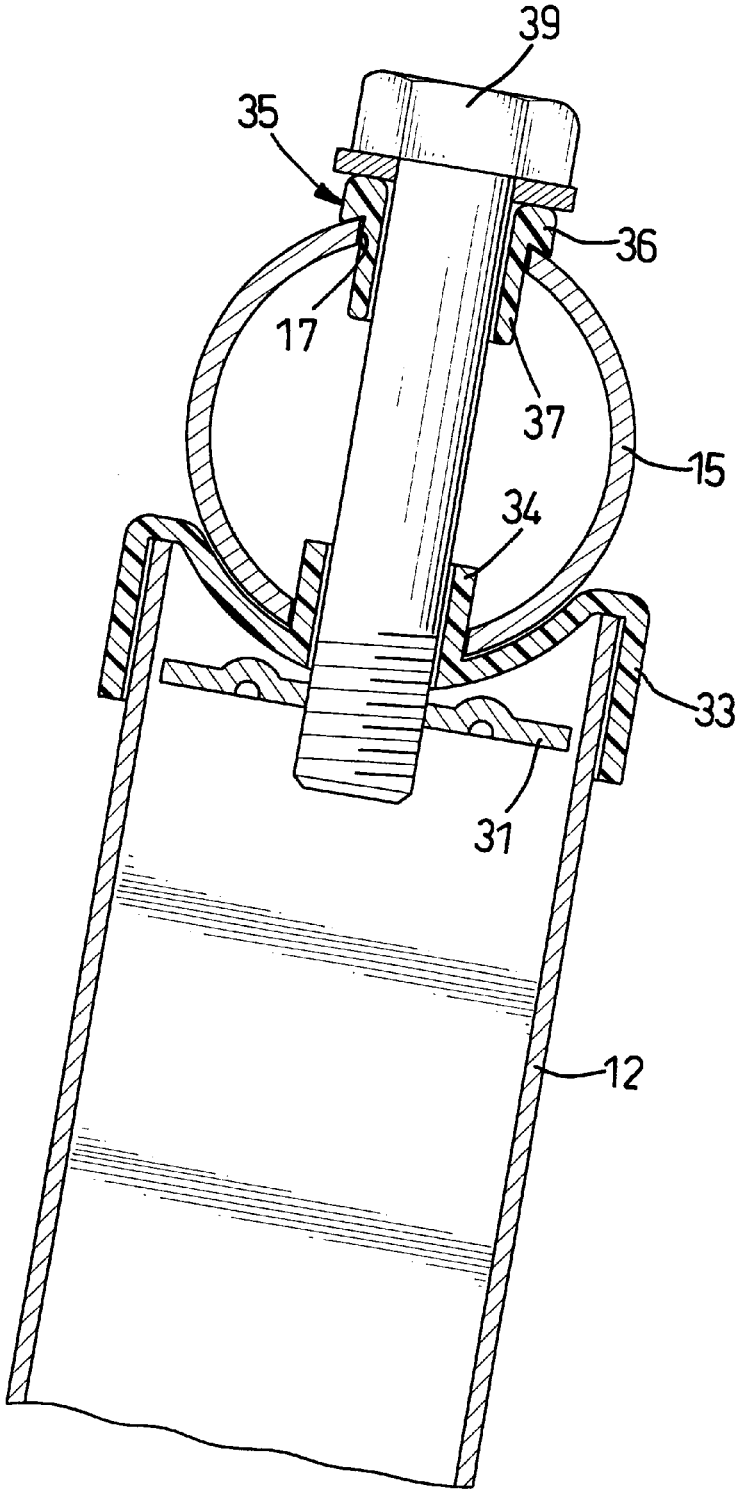
FIG. 4 is a side plan view in partial cross section of the second insulation connecting device in FIG. 3 along line 4–4 in FIG. 1.

With reference to FIGS. 1, 3 and 4, a second insulation connecting device (30) is mounted between the top end of each respective handle (15) and the top end of the corresponding post (12). Each second insulation connecting device (30) comprises a through hole (17), a connecting plate (31), a third insulation element (35), a fourth insulation element (33) and a bolt (39). The through hole (17) is defined through the corresponding handle (15). The connecting plate (31) is attached to the top of the corresponding post (12) and has a thread hole aligning with the through hole (17) in the corresponding handle (15). The third insulation element (35) is made of an insulation material and is mounted in the through hole (17) at the end far from the corresponding post (12). The third insulation element (35) has a sleeve (37) inserted into the through hole (17) in the corresponding handle (15) and a head (36) connected to the sleeve (37) and exposed from the corresponding handle (15). A passage is defined through each third insulation element (35). At least one protrusion (38) is formed on the sleeve (37) of each third insulation element (35) and abuts the inner surface of the corresponding handle (15). With the protrusions, the third insulation element (35) is kept from escaping from the handle (15).

Each fourth insulation element (33) is located between the corresponding handle (15) and the corresponding post (12) to separate the handle (15) from the corresponding post (12). Each fourth insulation element (33) has a sleeve (34) provided with a passage and inserted into the through hole (17) in the corresponding handle (15).

The bolt (39) penetrates through the passages of the insulation elements (33,35) and is screwed into the thread hole in the connecting plate (31). Accordingly, the top end of each handle (15) is securely attached to the top end of the corresponding post (12) through the second insulation connecting device (30).

With the insulation connecting assembly, the handles (15) are not electrically connected with the posts (12), such that the handles (15) are not electrically connected to the driving assembly (13) and the ground on which the treadmill is put. Accordingly, when the user holds the handles (15), an electrical circuit will not be formed between the user and the assembly or the ground. Consequently, the static electricity will not be discharged from the user or to the user, and this can keep the user from being injured. In addition, to mount coats made of an insulation material to the handles (15) is unnecessary, such that the appearance of the treadmill will not be influenced by the coat.

Figure 5:
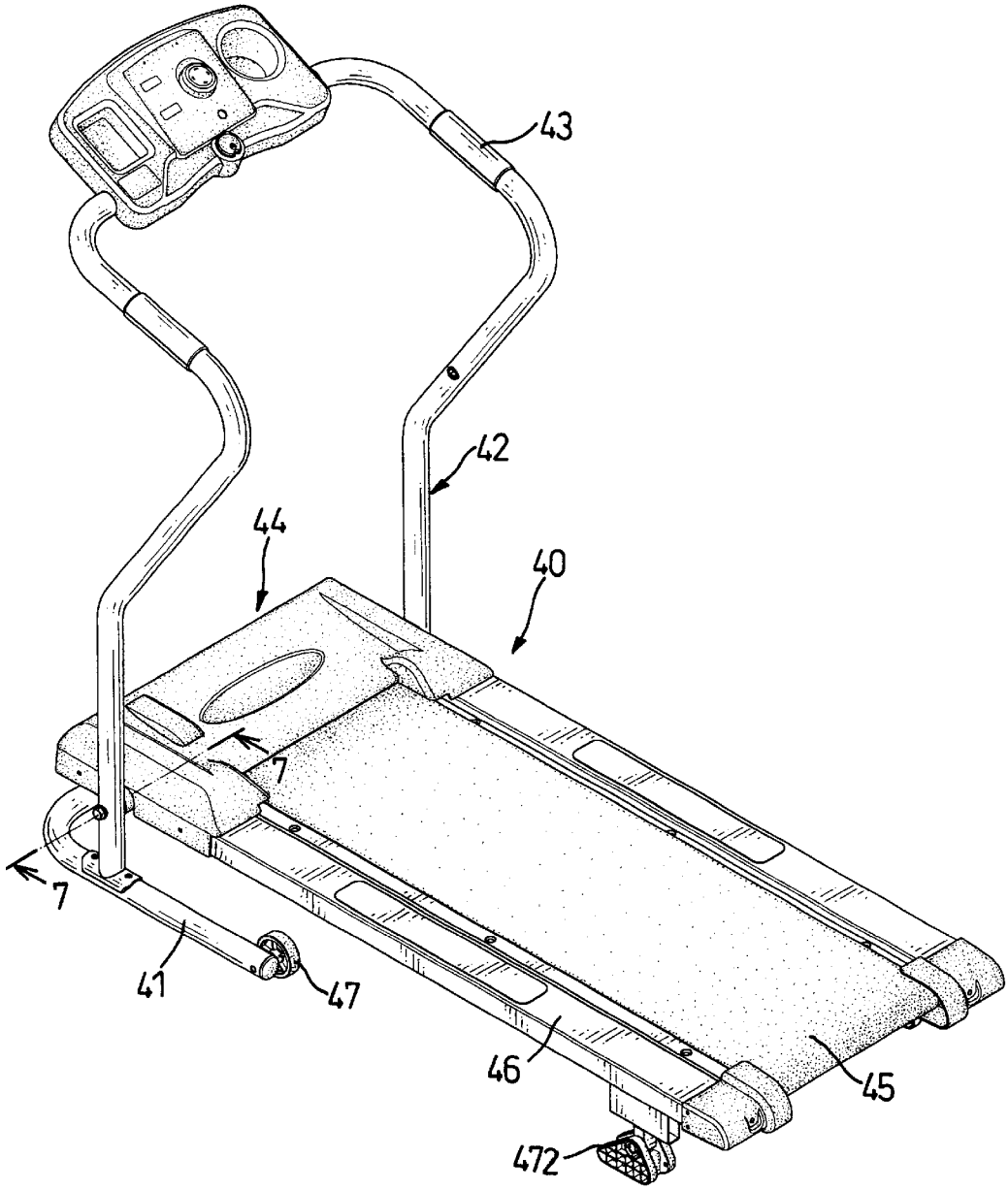
FIG. 5 is a perspective view of a second embodiment of a treadmill in accordance with the present invention.
Figure 6:
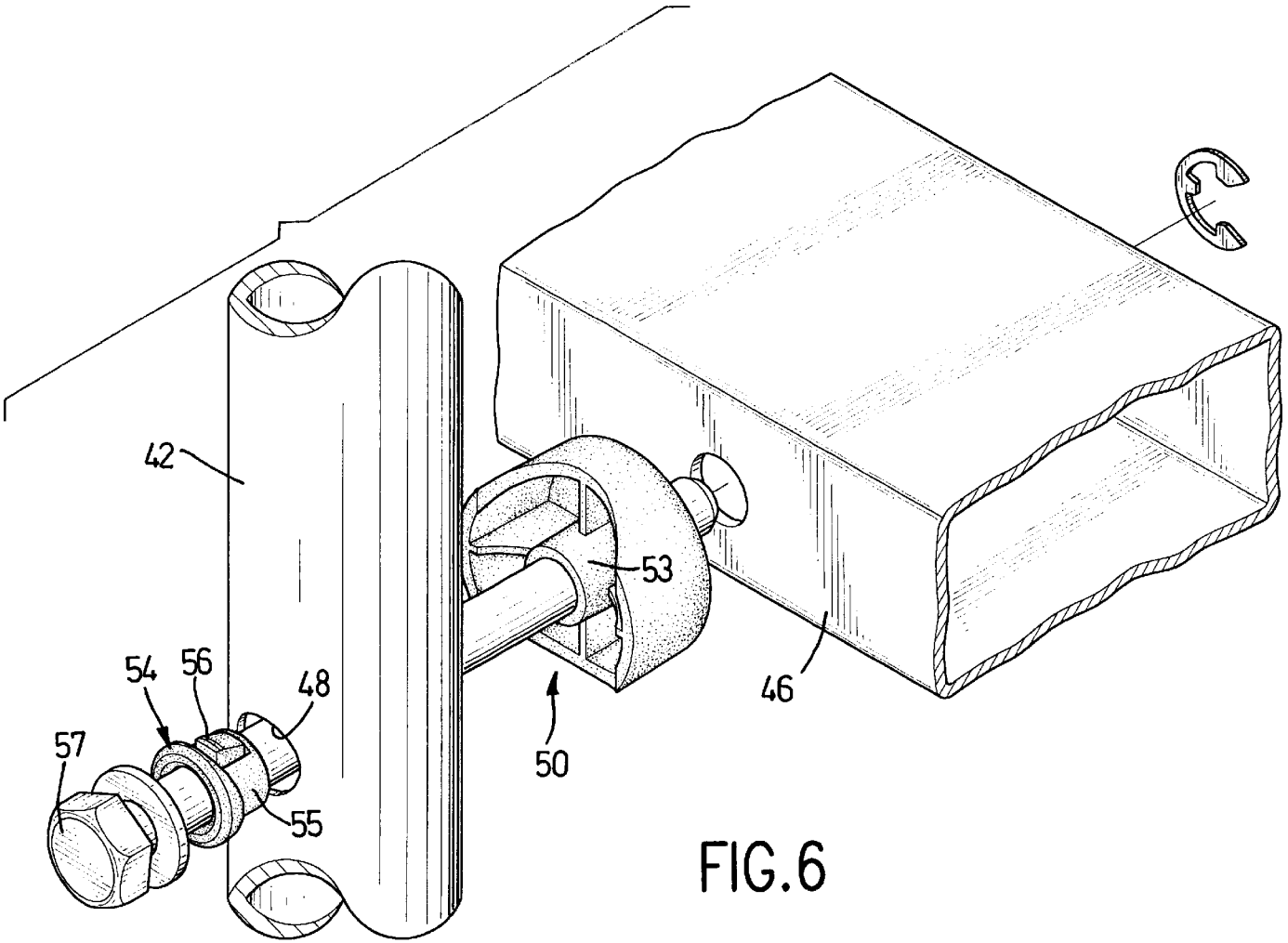
FIG. 6 is an exploded perspective of a third insulation connecting device of the treadmill in FIG. 5.
Figure 7:
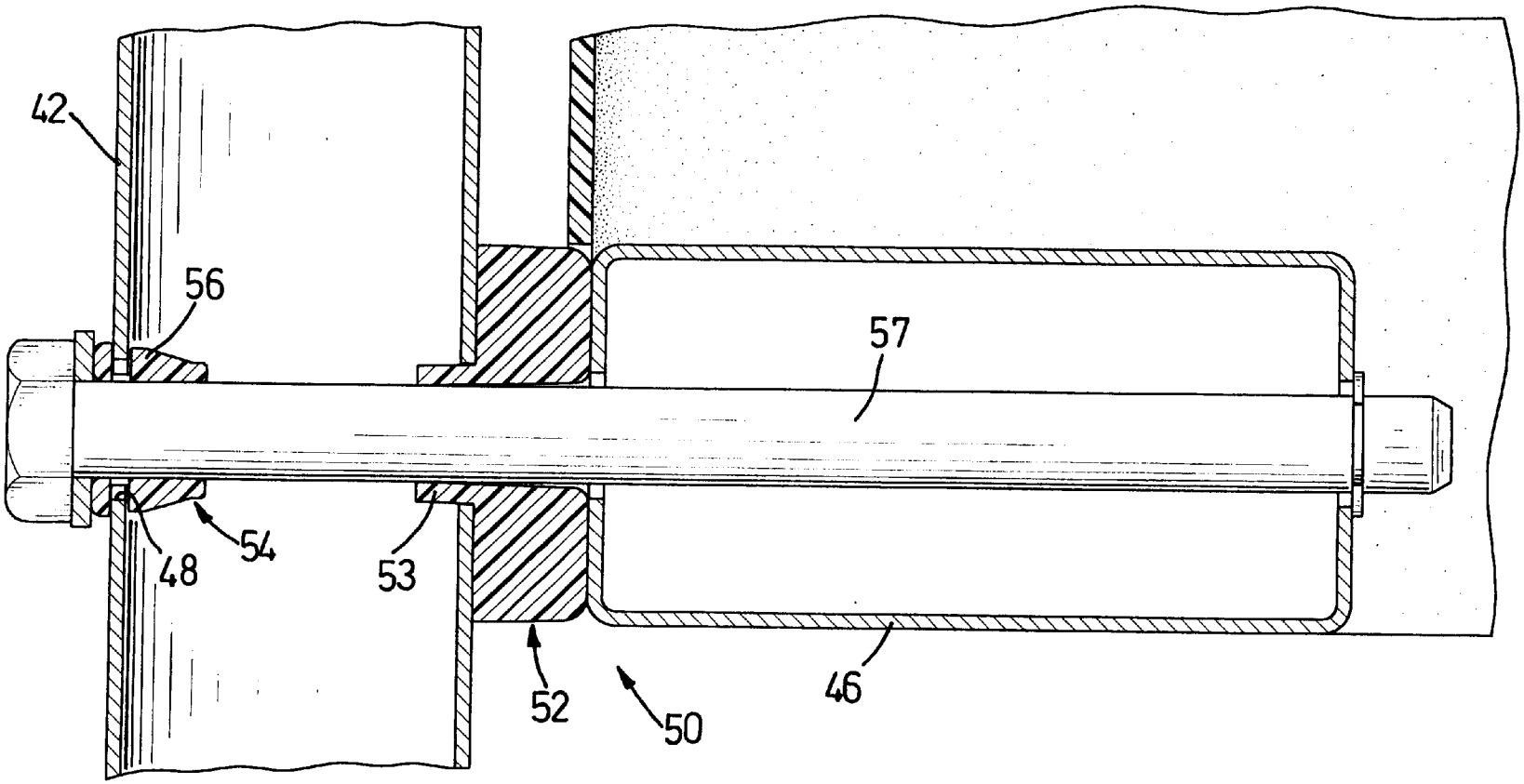
FIG. 7 is a side plan view in partial cross section of the third insulation connecting device in FIG. 6.

With reference to FIGS. 5 to 7, the insulation connecting assembly comprises two third insulation connecting devices (50) and at least one supporter (47). Each third insulation connecting device (50) is mounted on the position where the frame (46) is attached to the corresponding one of the posts (42). Each third insulation connecting device (50) comprises a first through hole (48), a second through hole (not numbered), a fifth insulation element (54), a sixth insulation element (52), a connecting bar (57) and a fastener (not numbered). The first through hole (48) is defined through the corresponding post (42). The second through hole is defined in the frame (46) and aligns with the first through hole (48) in the corresponding post (42). The fifth insulation element (54) is made of an insulation material and is mounted in the first through hole (48) at the end far from the frame (46). A passage is defined through each fifth insulation element (54). Each fifth insulation element (54) has a sleeve (55) inserted into the first through hole (48) and a head (not numbered) connected to the sleeve (55) and exposed from the corresponding post (42). At least one protrusion (56) is formed on the sleeve (55) of each fifth insulation element (54) and abuts the inner surface of the corresponding post (42) to keep the fifth insulation element (54) escaping from the post (42).

The sixth insulation element (52) is attached between the frame (46) and the corresponding post (42) to keep the frame (46) from contacting with the corresponding post (42). A passage is defined through the sixth insulation element (52) and aligns with the first through hole (48) in the corresponding post (42). A sleeve (53) provided with the passage is formed on each sixth insulation element (52) and is inserted into the first through hole (48) in the corresponding post (42).

The connecting bar (57) penetrates through the passages of the insulation elements (52,54) and the second through hole in the frame (46). The fastener is attached to the connecting bar (57) at the end extending out from the second through hole in the frame (46). Accordingly, each post (42) is securely attached to the frame (46) through the third insulation connecting device (50).

The first supporter (47) is made of an insulation material and is attached to the base (41) of the stand to keep the base (41) from contacting with ground. In practice, the first supporter (47) comprises two wheels mounted on the bottom of the base (41) to support the base (41). At least one second supporter (472) is made of an insulation material and is attached to the bottom of the frame (46) of the running assembly to keep the frame (46) from contacting with the ground. With the supporter (47,472), the treadmill (46) can be put on the ground in stable.

With the insulation connecting assembly, the posts (42) are not electrically connected with the driving assembly (44) and the ground, such that the handles (43) attached to the posts (42) are not electrically connected to the driving assembly (44) and the ground. When the user holds the handles (43), an electrical circuit will not be formed between the user and the driving assembly (44) or the ground. The static electricity that is generated by the friction between the shoes on the user and the running belt (45) will not be discharged, and this can keep the user from being injured. Thus, it is safe to use the treadmill (40) due to the static electricity free handle assembly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A treadmill comprising;

a stand;

a running assembly attached to the stand;

a handle assembly attached to the stand; and an insulation connecting assembly mounted on the stand to keep the handle assembly from electrically connecting with the running assembly.

2. The treadmill as claimed in claim 1, wherein the stand comprises a base and two posts extending upward from the base; and the running assembly is mounted between the two posts.

3. The treadmill as claimed in claim 2, wherein the handle assembly comprises two handles respectively secured to the posts.

4. The treadmill as claimed in claim 3, wherein the insulation connecting assembly comprises an insulation connecting device mounted on each respective position where each respective handle is attached to the corresponding one of the posts.

5. The treadmill as claimed in claim 4, wherein each insulation connecting device comprises:

a through hole with two ends defined through the corresponding one of the handles;

a thread hole defined in the corresponding post and aligning with the through hole in the corresponding handle;

an insulation element with a passage made of an insulation material and mounted in each respective end of the through hole to keep the handle from contacting with the corresponding post; and a bolt penetrating through the passages of the insulation elements and screwed into the thread hole in the corresponding post.

6. The treadmill as claimed in claim 5, wherein each insulation element has a sleeve inserted into one end of the through hole in the corresponding handle and a head connected to the sleeve and exposed from the corresponding handle and;

the head of one of the insulation elements is located between the corresponding handle and the corresponding post to separate the handle from the corresponding post.

7. The treadmill as claimed in claim 4, wherein each insulation connecting device comprises:

a through hole with two ends defined through the corresponding one of the handles;

a connecting plate attached to the corresponding post and having a thread hole aligning with the through hole in the corresponding handle;

a first insulation element with a passage made of an insulation material and mounted in the through hole at the end far from the corresponding post;

a second insulation element attached to the corresponding post and having a passage defined through the second insulation element and aligning with the through hole in the corresponding handle;

a bolt penetrating through the passages of the insulation elements and screwed into the thread hole in the connecting plate.

8. The treadmill as claimed in claim 7, wherein the first insulation element has a sleeve inserted into the through hole in the corresponding handle and a head connected to the sleeve and exposed from the corresponding handle;

the second insulation element is located between the corresponding handle and the corresponding post to separate the handle from the corresponding post and has a sleeve provided with the passage and inserted into the through hole in the corresponding handle.

9. The treadmill as claimed in claim 2, wherein the running assembly comprises:

a frame mounted between the posts;

a running belt mounted around the frame; and a driving assembly attached to the frame to drive the running belt to move around the frame in a loop; and the insulation connecting assembly comprises an insulation connecting device mounted on each respective position where the frame is attached to the corresponding one of the posts and at least one first supporter made of an insulation material and attached to the stand to keep the stand from contacting with ground.

10. The treadmill as claimed in claim 9, wherein each insulation connecting device comprises:

a first through hole with two ends defined through the corresponding one of the posts;

a second thread hole defined in the frame and aligning with the first through hole in the corresponding post;

a first insulation element with a passage made of an insulation material and mounted in the end of the first through hole far from the frame;

a second insulation element attached between the frame and the corresponding post to keep the frame from contacting with the corresponding post and having a passage defined through the second insulation element and aligning with the first through hole in the corresponding post;

a connecting bar penetrating through the passages of the insulation elements and the second through hole in the frame; and a fastener attached to the connecting bar at one end extending out from the second through hole in the frame.

11. The treadmill as claimed in claim 10, wherein the first insulation element has a sleeve inserted into the first through hole in the corresponding post and a head connected to the sleeve and exposed from the corresponding post;

the second insulation element is located between the corresponding post and the frame to separate the frame from the corresponding post and has a sleeve provided with the passage and inserted into the first through hole in the corresponding post.

12. The treadmill as claimed in claim 9 further comprising at least one second supporter made of an insulation material and attached to the frame of the running assembly to keep the frame from contacting with ground.

* * * * *